United States Patent [19]

Holzkämpfer et al.

[11] 4,285,178

[45] Aug. 25, 1981

[54] SELF-SUPPORTING STAIRCASE WITH CENTER POST CONSISTING OF INDIVIDUAL STRUCTURAL ELEMENTS

[76] Inventors: Günter Holzkämpfer, Sachsenhain 8, 3000 Hannover 51/BRD; Hans-Reiner Eilers, Mozartstrasse 5, 3000 Hannover 1/BRD, both of Fed. Rep. of Germany

[21] Appl. No.: 22,996

[22] Filed: Mar. 22, 1979

[30] Foreign Application Priority Data

Mar. 25, 1978 [DE] Fed. Rep. of Germany ..... 2813199

[51] Int. Cl.[3] ..... E04F 11/00

[52] U.S. Cl. ..... 52/187; 52/182

[58] Field of Search ..... 52/187, 188, 182, 177; 403/342, 373, 360; 285/384, 353

[56] References Cited

U.S. PATENT DOCUMENTS

| | | | |
|---|---|---|---|
| 1,885,316 | 11/1932 | Astley | 403/342 |
| 2,899,836 | 8/1959 | Cushman | 403/342 |
| 3,226,907 | 1/1966 | Gregoire | 52/28 |
| 3,246,438 | 4/1966 | Harting | 52/144 |
| 3,908,325 | 9/1975 | Kengott | 52/188 |

FOREIGN PATENT DOCUMENTS

| | | | |
|---|---|---|---|
| 2401013 | 7/1975 | Fed. Rep. of Germany | 52/181 |
| 2404428 | 8/1975 | Fed. Rep. of Germany | 52/187 |
| 2505117 | 8/1976 | Fed. Rep. of Germany | 52/188 |
| 11175 | 6/1884 | France | 52/187 |
| 2268918 | 12/1975 | France | 52/187 |
| 566467 | 9/1975 | Switzerland | 52/187 |

*Primary Examiner*—Price C. Faw, Jr.
*Assistant Examiner*—Henry E. Raduazo
*Attorney, Agent, or Firm*—Allegretti, Newitt, Witcoff & McAndrews

[57] ABSTRACT

A self-supporting staircase of which the treads are mounted on structural elements which interconnect in series to form an ascending center post. Each structural element comprises two spaced cylinders connected by a radial arm, the upper end of the first cylinder telescoping with the lower end of the second cylinder of an adjacent element in the series. Means is provided for securing the elements together. Thus the assembled elements are horizontally offset from each other to the extent required by the successive treads mounted on the elements.

9 Claims, 4 Drawing Figures

SELF-SUPPORTING STAIRCASE WITH CENTER POST CONSISTING OF INDIVIDUAL STRUCTURAL ELEMENTS

BACKGROUND OF THE INVENTION

The invention relates to a self-supporting free standing staircase including a center post or spar which is comprised of individual structural elements having treads fixed thereon. Each of the individual structural elements has at one end a top annular surface area and at the other end an annular bottom surface area. These two surface areas are tightly secured by means of screws.

In staircases of this type, the individual structural elements are required to be tightly secured together to insure the safety of the stairway with regard to its load capacity, as well as the prevention of any possible rotational movements of the structural elements. At the same time, it is desirable for the structural elements to be adjustable as to their angular positions to one another so that the stairway may be given, as far as possible, the desired curvature.

In the staircase disclosed by the German Pat. No. DE-PS 1,685,613, the structural elements consist of horizontal hollow profiles which are secured together at their ends by vertical clamping screws. To obtain the desired step rise, a spacer sleeve is positioned between the tightened ends of the hollow sections. To facilitate the attachment of the tread boards, the rectangular profile sections are provided with laterally extending brackets. This construction is material and labor intensive because a great many different parts have to be assembled and adjusted. A serious disadvantage is that the clamping screw, which is positioned substantially centrally with respect to the vertical spacer sleeve, requires considerable prestressing to insure a uniform widespread load distribution over the joint surface areas of the pressure tubing, and simultaneously, to prevent a lifting of the pressure tubing.

Similarly, the aforementioned disadvantages are also inherent in the prior art construction disclosed in the German Published Patent Application DE-OS No. 2,623,523, which basically covers the construction discussed previously and is distinguished from it essentially only by the different construction of the spacer sleeve. This spacer is made adjustable in its length by a thread so that the step rise can be adjusted.

German Pat. No. DE-PS 2,060,480 discloses a self-supporting staircase in which the individual members of the center pole or shaft are made of reinforced (steel) concrete and are directly secured to each other by a single clamping screw to facilitate their rotatability. Also in this prior art construction, the stresses in the region of the surface areas which are tightly fastened together, and also in the clamping screw, are considerable. The load capacity of the stairway is on the whole reduced.

To overcome these problems, German Pat. No. DE-PS 2,129,753 proposes a supporting structure for a flight of stairs in which the individual elements of the center post or shaft, which are made of steel, have tubular sections welded thereto which are adapted to be telescopically inserted into each other. At the desired depth of insertion and mutual rotational position, these metal tubing sections are clamped together by balls encased in holes in the inner tube and pushed by a tapered pin against the outer tube section.

This construction is extremely involved and thus expensive. Moreover, it has the disadvantage that the necessary clearance or play between the two telescoping tubular sections tends to be cumulative with the result that a sagging of the staircase may occur. It has the further disadvantage that the specific area pressure in the region of the balls is significant. In view of the necessary clearance between the tube sections it will be evident that the firm connection between the individual elements is established primarily by the balls, and that there is danger that the strong specific surface pressures may cause a flowing of the material and consequently, a relaxation or loosening of the connection. Furthermore, since the device consists of a multitude of parts, it is not impossible that some of them may be lost before the installation of the staircase is completed, especially the balls, unless special precautions are taken to retain the balls in the holes in which they are encased.

German patent No. DE-PS 1,683,276 discloses a self-supporting staircase having individual elements in the shape of supporting plates to the ends of which are welded bolt type projections of a relatively small diameter. The ends of these bolts are bevelled and are adapted to mate with similarly bevelled bores in which they are retained by relatively small screws. This bevelled fit makes this structure relatively complicated. Moreover, considerable stresses arise in the regions of the bevelled seats and also in the lock nuts, so that this structure is not suitable for conventional staircases. In addition, an angular orientation of the structural elements poses problems because the bevelled fit becomes so firmly interlocked at the slightest tightening of the lock nut that an angular adjustment is no longer possible. A further disadvantage is that an adjustment in the step rise is likewise impossible.

THE INVENTION

It is the object of the present invention to create a self-supporting staircase having a center shaft or post which consists of individual structural elements, to build the staircase in such a manner as to avoid strong stresses, to insure mechanical simplicity and low cost production, and to provide the features of angular adjustability of the structural elements and adjustability of the step rise.

The object of the invention is accomplised by providing an externally threaded member positioned adjacent to and coaxial with the upper annular surface area and projecting through an opening in the lower annular surface area of the adjacent structural element into the upper annular surface area. A screw nut is secured to the threaded member in such fashion that it reaches behind the opening.

In the staircase according to the invention, the bracing is effected directly in the region of the surface areas being braced, and not remotely therefrom, so that a good distribution of the bracing forces is achieved and any high specific loading is avoided. The bracing operation is carried out in known manner by means of a clamping screw being threaded in the direction of bracing, not by a centrally positioned clamping screw or turnbuckle, but rather by a threaded screw positioned in the region of the force transmitting annular surface areas. The screw thread may be easily cut in conventional fashion and the number of the required parts is limited to a minimum. The bracing operation by means of a screw thread facilitates a precise adjustment of the tensional forces which may initially be adjusted very low so that a rotation of the individual structural elements for the purpose of adjusting the angular positions with respect to each other is easily possible.

The screw nut may be safeguarded by a clamping screw to prevent any loosening at a later time.

A particularly advantageous feature of the present invention is the arrangement of spacer sleeves or rings between the two annular surface areas. This, of course, requires the external thread member to be of sufficient length. The exterior of the spacer sleeves or rings may be adapted to the shape of the structural elements between which the spacers are placed. Thus, by interposing spacer rings it is possible to adjust the step rise. It is to be noted that this adjustment can still be made at a later time, by following the given directions. In the prior art structure in which two tubular sections are telescopically engaged with each other, warps or bulges in the pressure regions have been known to appear already at only a slight tightening of the balls so that a rotational or axial adjustment of the tubular sections is very difficult or outright impossible.

The external thread is provided at a tubular projection of the structural element. It is particularly advantageous if the projection is an integral part of the element. However, it is also possible to provide the external thread on a separate tubular segment which is adapted to be screwed into the structural element.

In a preferred embodiment of the invention, which represents an invention by itself, the structural element consists of a cast steel body. In such a cast hollow body, all required members and surface areas are produced at the casting, with the exception of the screw nut which may be an inexpensive standard item. It is merely necessary to subject the cast part to a screw cutting operation and to machine finish the annular surface areas, if necessary, depending on the degree of precision of the cast. However, these operations can be performed mechanically and do not require any special input as is the case with the prior art exclusively welded structures.

By using a cast mold, each structural element may be given an aesthetically pleasing and simultaneously utilitarian exterior. In particular, the individual structural elements may be designed to have their exterior surface areas joined together without any seam or crack so that the joint areas are virtually invisible and the overall impression of a smooth continuous center post is created.

In the casting operation, the individual elements may easily be provided with integrally joined brackets for receiving the treads.

Another advantage of the structural element case as a hollow body is that the interior of the hollow body is available for additional means or items. For example, it is possible to fill sand into the hollow body for the purpose of damping any vibrations that may occur. The hollow body may also receive electric wiring. It is further possible to arrange lamps in the interior of the hollow body which throw their light through apertures in the wall of the hollow body to create special lighting effects.

DETAILED DESCRIPTION

Figure 1:
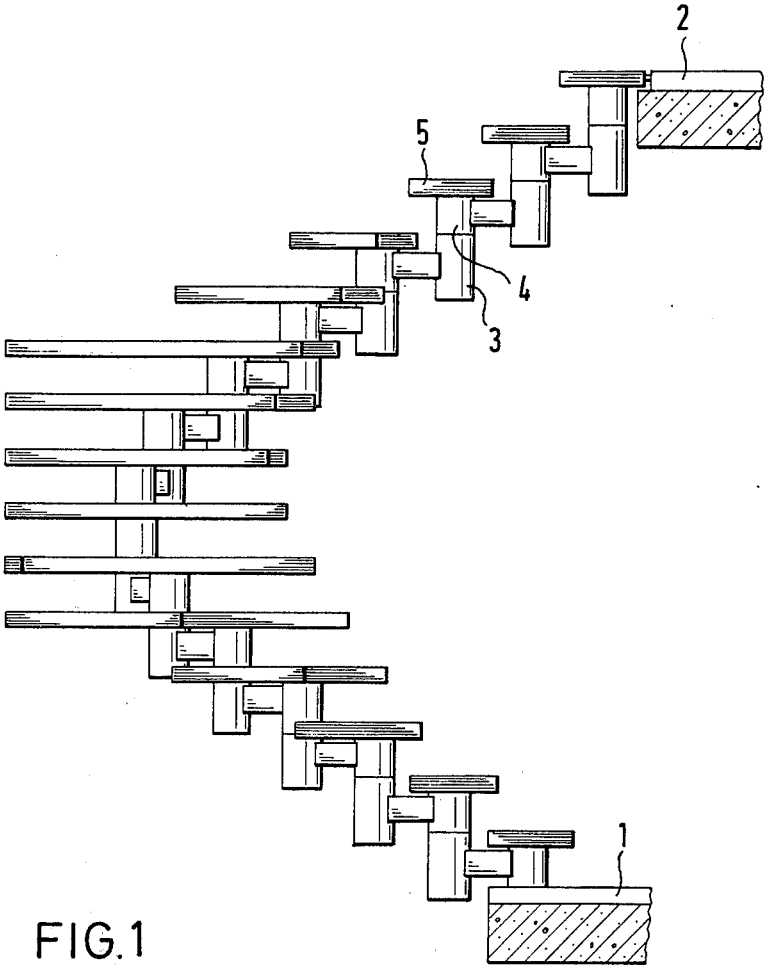
FIG. 1 illustrates a staircase of the invention extending between two floors.

The self-supporting free-standing staircase illustrated in FIG. 1 extends between two floors 1 and 2 of two stories. The staircase comprises individual structural elements 3 which are tightly secured to each other in the region of the surface areas 4 and are provided with treads 5. The structural elements are oriented at angles with respect to each other so that the overall projection of the stairway is U-shaped.

Figure 3:
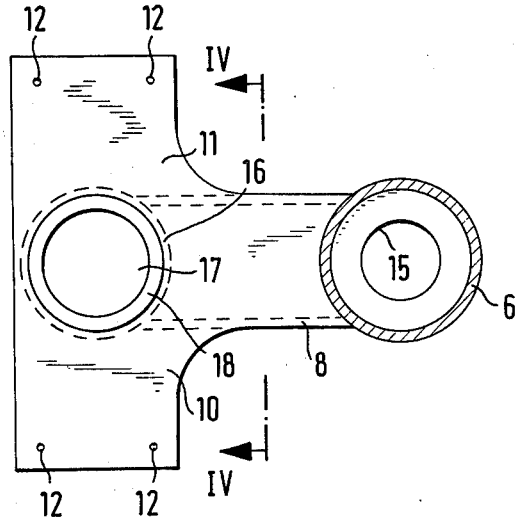
FIG. 3 shows a top view of a structural element.
Figure 4:
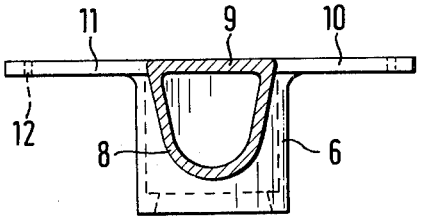
FIG. 4 shows a section taken along line IV—IV of FIG. 3.

One of the structural elements 3 of FIG. 1 is illustrated in an enlarged scope and in various views and sections in FIGS. 2–4, to which reference will be made in the following description.

The structural element 3 consists of a cast hollow body made of cast steel. Its two substantially cylindrical wall sections 6 and 7 are connected by an extension or arm 8 having a substantially semi-circular configuration, with a flat wall section 9 extending horizontally at the top. As will be seen particularly from FIG. 4, this wall section 9 is flush with the surface areas of brackets 10 and 11 which project to a small extent from the arm, but to the greater extent from the upper end of the cylindrical wall section 7. These brackets serve to accommodate the treads, not illustrated. To fasten the treads, the brackets 10 and 11 are provided with holes 12.

The wall section 6 rises slightly above the top surface of the wall section 9 of the arm 8 and forms a shoulder with a horizontal annular surface area 13. A tubular projection or stub 15, cast from steel together with the element 3 in one piece, forms an integral part of the element 3. It is provided with an exterior thread 14, is positioned adjacent the horizontal upper annular surface area 13 coaxially therewith, and projects upwardly from the annular surface area 13.

The cylindrical wall section 7, whose outer diameter is substantially the same as the outer diameter of the wall section 6, extends somewhat beyond the arm 8 in a downward direction and terminates in a horizontal annular surface area 16 which serves as an abutment surface for the annular surface area 13 of an adjacent structural element. The annular surface area 16 is provided with an opening 17, the walls 18 of which are slightly bevelled to facilitate an engagement with the tubular projection 15 of an adjacent structural element. The back of the wall 18 of the opening 17 is formed by an annular surface area 19 adapted to be engaged by a screw nut of an adjacent element to fasten together the annular surface areas 13 and 16 of two adjacent elements 3.

Figure 2:
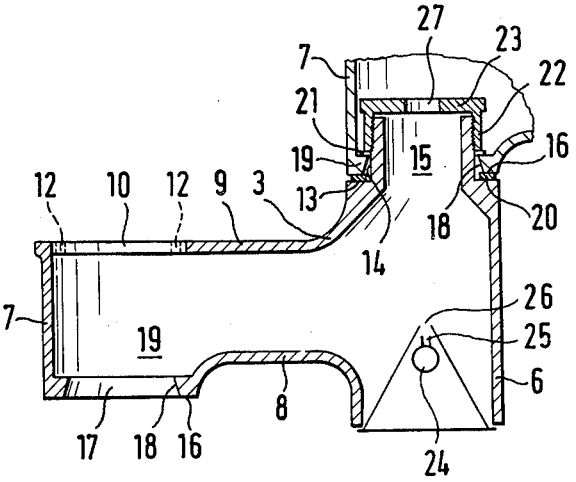
FIG. 2 shows adjacent structural elements.

FIG. 2 illustrates in its upper right hand portion a segment of an adjacent structural element, with identical parts being designated with identical but primed numerals. As will be seen, the lower annular surface area 16' is placed upon the annular surface area 13, with the spacer sleeve or ring 20 interposed therebetween. This spacer ring 20 enables the step rise to be adjusted. In addition, the spacer ring may facilitate a mutual rotation of adjacently located structural elements, and furthermore, if the annular surfaces 13 and 16' are unfinished, the spacer sleeve may also serve to bring about a uniform area load distribution. For this reason the spacer sleeve is made of a somewhat softer material. The annular surface area 19' is engaged by a ring 21 for easy rotatability and uniform pressure distribution; thus the ring 21 serves a similar purpose as the spacer ring 20.

The external thread 14 is in intimate engagement with a screw nut 22 which pushes against the ring 21 so that the upper element with its annular surface area 16' is firmly secured to the lower element 3 with its annular surface area 13. A disc 23 is fixedly attached to the screw nut 22 to facilitate a better rotation of the screw nut 22.

As will be seen from FIG. 2, the cylindrical wall section 6 is open at its lower end. This enables an electric lamp 24 to be positioned inside the wall section 6. The lamp is held by a fixture 25 and a small crossbar 26 and the light is directed downwardly. Since the elements 3 are hollow and the hollow bodies are in communication with each other, or can be made to communicate, for example by an opening 27 in the disc 23, it is possible to install an electric wire throughout the entire length of the center post consisting of the structural elements according to the invention, to connect lamps 24.

It is also possible to seal the lower end of the cylindrical wall by means of an integrally formed part or by a subsequently added part that may be made of e.g. sheet metal. In this embodiment, the hollow element 3 may be filled with sand to impart additional weight to the entire staircase. This not only reduces the danger of causing vibrations, by displacing the fundamental frequency downwardly, but the special advantage obtained is that due to the strong damping effect of the sand any inadvertently triggered vibrations are prevented from growing stronger.

We claim:

1. In a self-supporting staircase having a center post consisting of a plurality of individual interconnected structural elements, each structural element having a tread, an interior and means for tightly securing said structural elements relative to one another, the improvement comprising, in combination:

said structural elements being provided, at one end, with an integrally formed projected portion that extends away from said one end of said structural element, has a externally threaded segment thereon and defines an upper horizontal annular surface, and, at the other end, with an integrally formed opening that defines a lower horizontal annular surface;

said securing means including an internally thereaded member and being characterized in that, when a first structural elelment is assembled in conjunction with an adjacent structural element, said integrally formed projecting portion of the first structural element is positioned such that said externally threaded segment thereon extends through the opening of the adjacent structural element and the upper horizontal annular surface of the first structural element abuts the lower horizontal annular surface of the adjacent structural element defining an interface therebetween, said internally threaded member screwing onto said externally threaded segment and thereby securing the individual structural elements and their respective upper and lower horizontal annular surfaces relative to one another, and directing substantially all stress forces between adjacent structural members to be transmitted through the interface defined by said upper and said lower horizontal annular surfaces.

2. A staircase according to claim 1, characterized in that at least one spacer ring is provided between said upper and lower annular surface areas.

3. A staircase according to claim 1, characterized in that each of said structural elements is a hollow body made of cast steel.

4. A staircase according to claim 3, characterized in that the structural element comprises two vertical tubular members joined by a horizontal radial arm and each having a cylindrical wall section which includes one of said horizontal annular surface areas, the outer diameters of said cylindrical wall sections being substantially identical, such that the annular surface areas at the interface between two adjacent structural elements are joined together without a crack therebetween.

5. A staircase according to claim 4, characterized in that said radial arm is hollow and has a cross section which is of substantially semi-circular configuration at the bottom and flat at the top.

6. A staircase according to claim 3, characterized in that said hollow body is provided with integrally formed brackets for the attachment of treads.

7. A staircase according to claim 3, characterized in that said annular surface areas are machine-finished.

8. A staircase according to claim 3, characterized in that the structural elements are filled with sand.

9. A staircase according to claim 3, characterized in that a lamp is disposed in the interior of one of said structural elements, and that said element is provided with an aperture in the region of the lamp below said screw nut.

* * * * *